US005230679A

United States Patent [19]

Olsen

[11] Patent Number: 5,230,679

[45] Date of Patent: Jul. 27, 1993

[54] LIGHTWEIGHT LEG RESPOSITIONING, REHABILITATING AND EXERCISING DEVICE

[76] Inventor: Alice V. Olsen, 7457 E. Clovis Cir., Mesa, Ariz. 85208

[21] Appl. No.: 886,884

[22] Filed: May 22, 1992

[51] Int. Cl.[5] ..... A63B 21/002

[52] U.S. Cl. ..... 482/91; 482/907; 482/114

[58] Field of Search ..... 482/82, 114, 140, 907, 482/81, 91, 74

[56] References Cited

U.S. PATENT DOCUMENTS

| | | | |
|---|---|---|---|
| 3,118,666 | 1/1964 | Fitch | 482/81 |
| 4,002,462 | 5/1977 | Pena-Kipper | 482/81 |
| 4,049,264 | 9/1977 | Holcombe, Jr. | 482/81 |
| 4,177,985 | 12/1979 | Hlasnicek et al. | 482/82 |
| 4,315,623 | 2/1982 | Granderson | 482/81 |
| 4,335,875 | 6/1982 | Elkin | 482/74 |
| 4,691,917 | 9/1987 | Battista | 482/74 |
| 4,890,829 | 1/1990 | Burton | 482/82 |
| 4,919,417 | 4/1990 | Poulas | 482/82 |
| 5,071,118 | 12/1991 | Barnett | 482/82 |
| 5,087,034 | 2/1992 | Solis | 482/82 |

*Primary Examiner*—Richard J. Apley
*Assistant Examiner*—Lynne A. Reichard
*Attorney, Agent, or Firm*—Antonio R. Durando; Harry M. Weiss

[57] ABSTRACT

A device for moving, repositioning, rehabilitating and exercising a leg that has been immobilized by injury, illness, surgery or general infirmity. The device comprises a single length of firm and non-stretchable tubing made of lightweight porous material reinforced by an inner core running through its hollow center and encased at both ends by a hand grip consisting of a protective non-slip covering, and encased in the middle of the length of the tube by another like section of non-slip covering to minimize slippage of a foot placed on it for movement of the leg. In operation, a user places the middle portion of the device under the sole of her foot and exerts control over the position of the leg by pulling both ends of the device, thus maneuvering the foot and leg in the desired direction. Because of its lightweight characteristics, the invention is easy to operate and also provides a tool that can be utilized for simple toning exercises for the legs and arms of its user. As an exerciser, the device places minimal strain on the body while still providing some movement to an otherwise immobile body, an obvious benefit where the user is recovering from an operation or injury or is generally infirm.

12 Claims, 1 Drawing Sheet

LIGHTWEIGHT LEG RESPOSITIONING, REHABILITATING AND EXERCISING DEVICE

BACKGROUND OF THE INVENTION

1. Field of the Invention

This invention is related to the general field of equipment and devices to aid the movement, physical rehabilitation and exercise of injured body limbs. In particular, the invention provides a new device to allow a person to move, reposition and exercise her legs when, due to injury, surgery, illness or other infirmity, she cannot do so without assistance.

2. Description of the Prior Art

After surgery or injury to a leg, during an illness or other general infirmity affecting the use of a leg, a person may find that moving or repositioning her legs is impossible because too painful or because it presents a risk of additional injury. Typically, the person is confined to a bed or chair and is not supposed to use her leg muscles to effect any change in the position of the injured leg. Nonetheless, the leg needs to be repositioned from time to time to minimize irritation to the skin and exercised to avoid muscle debilitation, both of which have a negative effect on recovery. Thus, during the course of a day such person might try to help the leg by lifting it with her arms, by maneuvering it with the rest of her body, or by utilizing makeshift prosthetic apparatus as an aid in moving the limb for relief from prolonged inactivity. In fact, under such circumstances the person would probably need assistance in changing the placement and position of her legs.

In order for an incapacitated leg to be moved, it must be lifted and maneuvered into the desired new position either manually or by some device designed for that purpose, such as is often found mounted on hospital beds for orthopedic applications. Typically one would grab the leg under the thigh with both hands and pull it up by using the strength of the arms and back muscles, while directing it to a new position, as desired. Obviously, this is more easily done with the help of others. Even using a special device, though, the assistance of another person may be required because such devices tend to be bulky, complicated and difficult to operate.

Conventional hospital-bed apparatus, for example, is normally operated either manually or electrically and utilizes a system of pulleys and levers with a rope attached to a leg support. The device causes the rope to lift the leg and move it while it is suspended. Because of their intended multi-purpose application, these devices tend to be complex and expensive. Moreover, immobilization resulting from an operation, injury or illness is often a short term condition. Therefore, in such cases and in cases where funds are limited, immobilized persons are often reluctant to spend money for a special device dedicated to perform this task for a limited period of time.

Obviously, one could construct a simple makeshift device using a length of rope or cord, stretchable or not, attached to or wrapped around the leg, or a foot or shoe, and operated by the immobilized person by pulling the ends of the rope to lift and reposition the leg. For example, a jump rope could be passed around the bottom of one's foot and held taut by pulling both handles in an upward direction against the pressure of the foot, thus causing the foot and leg to be lifted free of the supporting surface. The successful completion of this kind of operation, though, depends on the ability of the immobilized person to get the rope in place, so that the desired motion can be achieved by pulling and maneuvering the rope. If the user is not able to place the rope at a strategically useful point on the foot, the assistance of another person is still needed. Such devices are, therefore, ineffective, impractical and of little use.

Many simple exercise devices currently on the market are used in a way that results in the lifting of one's legs or the moving of other body parts. For example, U. S. Pat. No. 1,810,255, issued to Poulus in 1931, shows a body building device consisting of an elastic band with a knob at each end for gripping and pulling to perform multiple exercises. This invention is the first in a sequence of similar patents granted to inventors for various apparatus consisting mainly of a single elastic member, all of which could be used, in an awkward manner, to pull up and move a disabled leg.

In U.S. Pat. No. 2,224,103 (1940), Nilson discloses a similar device composed of parallel elastic straps joined at each end, so that a user can readily perform beneficial exercises by anchoring one side of the device over one part of the body, such as a foot, and stretching it by pulling with another part of the body, such as a hand. Special cuffs are also provided to form handles at each end of the apparatus, if desired for better grip.

U.S. Pat. 3,256,015 to Perrin (1966) shows a multipurpose device that can be adapted for a variety of different exercises. The main objective of the invention is to approximate the motions involved in various athletic events, so that the athlete can build up his or her strength in preparation therefor.

In U.S. Pat. No. 3,838,852 (1974), Gury describes a one-piece resilient strand of circular cross-section and incorporating a looped strap at each end. These straps function as convenient handles that can be looped around various parts of a user's body to perform stretching exercises.

U.S. Pat. No. 4,040,620 to Friedman (1977) discloses a similar invention where the resilient strand is telescopically encased in hollow tubular members forming two handles. As these are pulled, the elastic strand is extracted from the tubular handles and calibrated exercises may be performed.

Finally, in U.S. Pat. No. 4,570,921 (1986), Arnold teaches a calibrated tubular elastic exercising device that can be used in workouts involving a variety of different muscles. The novelty of the invention consists of a calibration along the length of the elastic, cylindrical tube that gives the user a quantitative measure of the level of activity. Therefore, a more organized and articulated plan of exercise can be achieved.

Devices designed primarily as exercises, however, are generally unsuitable as leg repositioners in the situations described here. They are flexible, making it difficult to maneuver, and elastic, rendering them somewhat hard to control and possibly dangerous. By their nature and purpose, these exercising devices subject the body to stress, strain and impact that is inappropriate at best and dangerous at worst for an immobilized person whose only need is a new position for her leg. Thus, using an exercise device as a leg repositioner is an unsatisfactory attempt to adapt the device to fill a need that remains unmet. All of the devices described above are exercisers based on the elastic characteristics of their principal feature. None are intended, nor suited, for use in moving and repositioning injured or immobilized legs. As a result, there still exists a need for a simple and inexpensive device to facilitate the movement and repositioning of an injured leg without assistance by third parties.

The present invention provides a new device for allowing a person to move, reposition and exercise her legs when, due to injury, illness or other infirmity, she cannot do so without assistance. Because of its simplicity, this invention is very inexpensive, thus making it attractive even to those with short term needs.

BRIEF SUMMARY OF THE INVENTION

One objective of this invention is to provide a device that allows a person, immobilized by injury, surgery, illness or general infirmity, to move and reposition her legs without the assistance of another person.

Another objective of the invention is that it be comfortable and safe to use.

Another goal of the invention is a device that is very simple, efficient and easy to use.

Another objective is that the invention consist of a lightweight structure to minimize discomfort and the chance of injury to the user.

Yet another objective of the invention and the method of using it is that a user may achieve a certain level of exercise in conjunction with its primary purpose as a leg positioner.

A final objective is the manufacture of a device that is inexpensive enough to be attractive to one whose prospective needs appear to be short term. This is achieved by using commercially available materials in a very simple construction configuration.

According to these and other objectives, the present invention describes a device for moving, repositioning, rehabilitating and exercising a leg that has been immobilized by injury, illness, surgery or general infirmity. The device comprises a single length of firm and non-stretchable tubing made of lightweight porous material reinforced by an inner core running through its hollow center and encased at both ends by a hand grip consisting of a protective non-slip covering, and encased in the middle of the length of the tube by another like section of non-slip covering to minimize slippage of a foot placed on it for movement of the leg. In operation, a user places the middle portion of the device under the sole of her foot and exerts control over the position of the leg by pulling both ends of the device, thus maneuvering the foot and leg in the desired direction. Because of its lightweight characteristics, the invention is easy to operate and also provides a tool that can be utilized for simple toning exercises for the legs and arms of its user. As an exerciser, the device places minimal strain on the body while still providing some movement to an otherwise immobile body, an obvious benefit where the user is recovering from an operation or injury or is generally infirm.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DETAILED DESCRIPTION OF THE INVENTION

This invention consists of a simple device designed to enable a person whose legs or legs have been immobilized by injury, illness, or surgery to move and reposition them without outside assistance. The invention is sufficiently lightweight, simple to use and efficient that a person can move and reposition her legs at any time without being dependent on anyone but herself. In addition, the invention can be used to simply exercise the legs by moving them and then returning them to the same position.

Figure 1:
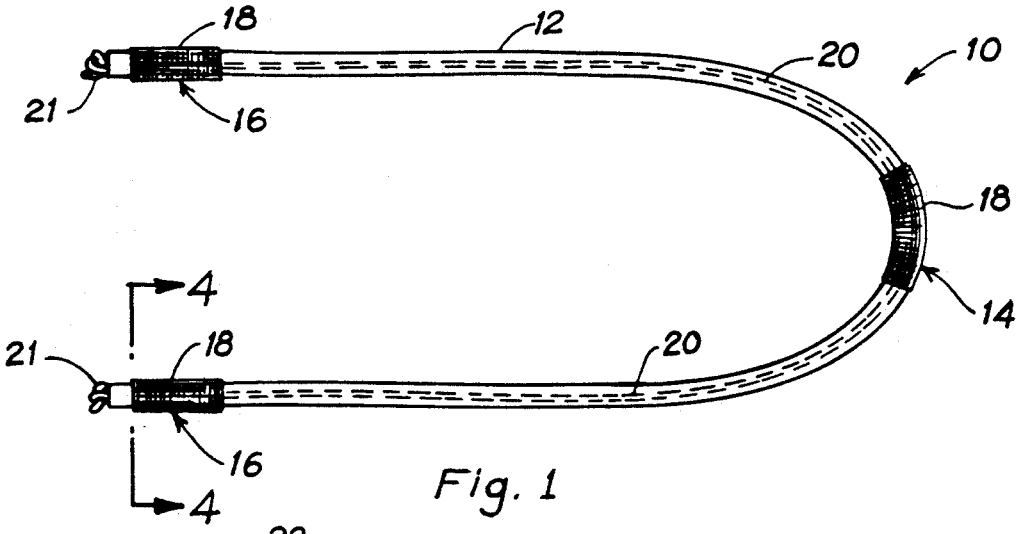
FIG. 1 is a perspective view of a leg positioner according to the preferred embodiment of this invention.
Figure 5:
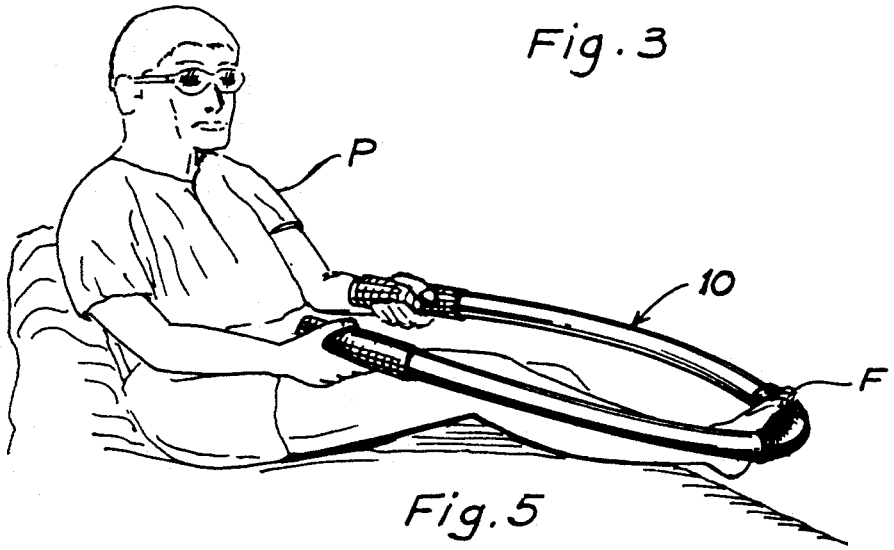
FIG. 5 illustrates a person using the leg repositioner of the invention to effect movement of her leg.

Referring to the drawings, wherein like parts are designated throughout with like numerals and symbols, FIG. 1 is a perspective view of the leg positioner 10 of the invention. It comprises a U-shaped cylindrical body or tubing 12 approximately five feet long and having an outside diameter of about 1.75 inches. While the member 12 is shown as a tube in the preferred embodiment, a curved cylindrical body would also have the necessary features for providing the advantages of the invention. The tubing 12 has a middle foot portion 14, intended to function as a foot sling, and two end portions 16 functioning as handles for a user to grab and pull while supporting the weight of the foot placed on the foot portion 14. I found that a length of five feet is particularly suitable because it can be used by people of various heights, inasmuch as it is sufficient for even very tall individuals to reach the sole of their feet and it is not too long for even short people to use by making appropriate adjustments with their arms. The cylindrical body or tubing 12 must consist of non-stretchable material with sufficient rigidity to retain its general shape under its own weight. That is, as a user holds the device by the handles out in front of her, it must not fold under its own weight, so that it can be extended forward as a loop to wrap around and support the bottom of the user's foot in sling-like fashion, as illustrated in FIG. 5. A synthetic dense foam material, of the type used for refrigeration pipe insulation, which can be compressed but not stretched, is ideal for this application. In particular, I found that the pipe insulation sold by Thermwell Products Company of Los Angeles, California, under the trademark "Frost King" is a perfect off-the-shelf tubing for this application. The material constituting this insulation is closed-cell polyethylene foam.

In the preferred mode of implementing the invention, an inner core 20, consisting of a segment of non-stretchable rope or similar cylindrical material threaded through the hollow center of the tubing 12 and tied to form a knot 21 at each end thereof to prevent it from sliding therethrough, may be used as a safety feature. Thus, in case of breakage of the tubing 12 under tension while pulling on a foot, the inner core 20 would provide the necessary support to retain the foot in place and avoid possible injury to the limb. Obviously, the diameter of the inner core 20 must be smaller than the inside diameter of the tubing 12, so that it can be inserted therethrough. Preferably, the diameter of the inner core 20 should be only slightly smaller than the inside diameter of the tubing 12, so that its retention within the tubing may be achieved simply by tying a knot at each end, as illustrated in FIG. 1. For the purpose of minimizing the overall weight of the device, the inner core 20 may consist itself of hollow tubing, preferably made of lightweight plastic, such as the vinyl tubing sold by Mojax Plastic Manufacturing, Inc. of Whittier, California.

In order to improve the grip on the handles and reduce the possibility of slippage of the device off a user's foot while being used to move a disabled leg, a layer of non-slip material is wrapped around the foot portion 14 and the handle portions 16. I found that the non-slip rug cushioning material sold by Camco Manufacturing Inc. of Greensboro, North Carolina, under the trademark "Slip-Stop" is ideal for this application. A single layer wrapped around the handle portions 16 of the tubing 12 provides the necessary friction to allow an average person to hold on to the handles and lift a leg by pulling without having to squeeze the handles very hard. Since the outside surface of the tubing determines the area of contact with the hands of a user, it is important that its size be appropriate for maximum hold with a minimum of effort. I found that the closed-cell polyethylene foam material mentioned above, which is firm but spongy, so that it can be squeezed slightly, in an outside diameter of approximately 1.75 inches, has the characteristics necessary to allow a firm grip for the average user. The non-slip material wrapped around the handle portions of the device further ensure the stability of the grip. Similarly, a layer of non-slip material wrapped around the foot portion 14 ensures good and stable contact while the user raises the foot by pulling the handles of the device.

Figure 4:
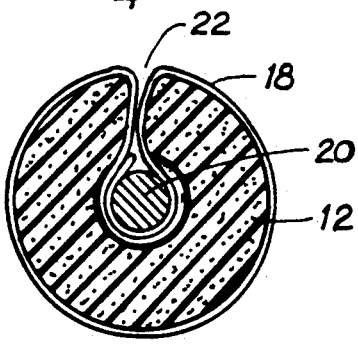
FIG. 4 is a cross-sectional view of the leg repositioner of the invention as seen from line 4—4 in FIG. 1, illustrating the non-slip covering encasing the handle portions thereof.
Figure 2:
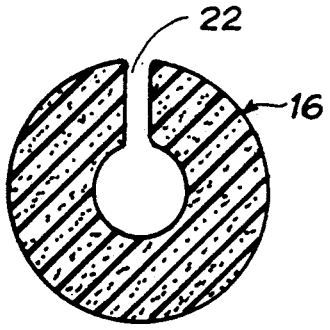
FIG. 2 is a cross-sectional view of a portion of the outer tubing constituting the leg repositioner of the invention illustrating a longitudinal slit cut along its wall.
Figure 3:
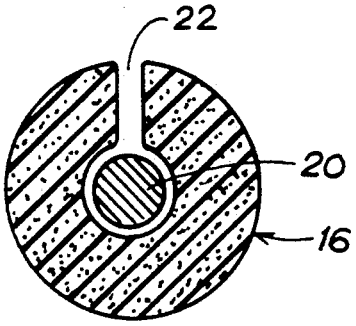
FIG. 3 is the same cross-sectional view of FIG. 2 also illustrating a reinforcing inner core inside the outer tubing of the invention.

The non-slip material 18 may be glued to the surface of the tubing 12, or attached to it by any equivalent means. In order to simplify the construction of the device, though, I found that the glue or other fastening material may be saved by utilizing the tubular structure of the tubing 12 to provide a means for attaching the non-slip material to the device. FIG. 2 shows a cross-section of the tubing 12 taken within a handle portion 16, for example, wherein one side of the wall has been scored to provide a longitudinal slit 22 between the inner and outer surfaces of the tube. FIG. 3 is the same view illustrating, in addition, the solid reinforcing inner core 20. As seen in FIG. 4, which is a cross-sectional view taken from line 4—4 in FIG. 1, the non-slip material 18 can be fastened to the tubing 12 by inserting it through the slit 2 and wrapping it around the inner core 22 to lock it in place. This can be accomplished by first pulling the inner core 20 out from inside the tubing 12 through the slit 22; then by enveloping the corresponding portion of the tubing with a band of non-slip material 18 and wrapping its loose ends around the portion of inner core exposed through the slit; and finally by pushing the inner core with the loose ends of non-slip material wrapped around it back inside the tubing 12. The result is the structure shown in FIG. 4.

Thus, a simple and yet very effective tool is obtained for increasing the mobility of a person relegated to bed by a leg injury. As illustrated in FIG. 5, such a person P is enabled to lift her leg by positioning the tool 10 so that the foot portion 14 is in contact with the sole of her foot F. Then, by clenching the handle portions 16 and pulling toward her head, the person can cause the foot to be raised, thereby lifting the leg as well, and can direct the entire limb to a different position, as desired.

Various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus and methods.

What I claim as my invention is:

1. A device designed to enable a user to move an injured leg and foot resting in an extended position by looping the sole of the foot and lifting the foot so as to provide freedom of movement to the leg, comprising:

(a) a single-piece non-stretchable segment of tubing having a hollow center, an inner surface and an outer surface, and having a curved middle section and two ends; said curved middle section being a substantially U-shaped foot portion, said two ends being two handle portions, and said tubing being made of material with sufficient rigidity to retain its general shape under its own weight; and (b) a layer of non-slip material wrapped around said foot portion and said two handle portions;

whereby said foot portion is used as a foot sling to hold and lift the foot of the user while clenching and pulling said two handle portions.

2. The device described in claim 1, wherein said single-piece non-stretchable cylindrical body consists of one segment of tubing.

3. The device described in claim 2, further comprising an inner core consisting of a segment of non-stretchable cylindrical material inserted through the center of said tubing and tied at each end of the tubing to prevent the inner core from sliding therethrough.

4. The device described in claim 3, wherein the diameter of said inner core is only slightly smaller than the inside diameter of said tubing, so that the retention of the inner core within the tubing may be achieved simply by tying a knot at each end of the inner core.

5. The device described in claim 3, wherein said inner core consists of hollow plastic tubing.

6. The device described in claim 5, wherein said inner core consists of vinyl tubing.

7. The device described in claim 3, wherein said layer of non-slip material wrapped around said foot portion and said two handle portions consists of non-slip rug cushioning material.

8. The device described in claim 2, wherein said single-piece non-stretchable segment of tubing is approximately five feet long and has an outside diameter of about 1.75 inches.

9. The device described in claim 2, wherein said single-piece non-stretchable segment of tubing is made of a dense synthetic foam material.

10. The device described in claim 9, wherein said dense synthetic foam material is closed-cell polyethylene foam.

11. A device designed to enable a user to move an injured leg and foot resting in an extended position by looping the sole of the foot and lifting the foot so as to provide freedom of movement to the leg, comprising:

(a) a non-stretchable segment of tubing having a hollow center, an inner surface and an outer surface, and having a curved middle section and two ends; said curved middle section being a substantially U-shaped foot portion, said two ends being two handle portions, and said tubing being made of material with sufficient rigidity to retain its general shape under its own weight;

(b) a layer of non-slip material wrapped around said foot portion and said two handle portions; and (c) an inner core consisting of a segment of non-stretchable cylindrical material inserted through the hollow center of said tubing and tied at each end of the tubing to prevent the inner core from sliding therethrough;

wherein said layer of non-slip material wrapped around said foot portion and said two handle portions is fastened to said segment of tubing by scoring said portions of the tubing to provide longitudinal slits between the inner and outer surfaces thereof; by extracting said inner core from inside the tubing through said slits; by enveloping each of said portions of the tubing with a band of said non-slip material having two loose ends and wrapping the loose ends thereof around the portion of inner core exposed through each slit; and finally by pushing the inner core with the loose ends of non-slip material wrapped around it back inside the tubing;

whereby said foot portion is used as a foot sling to hold and lift the foot of the user while clenching and pulling said two handle portions.

12. A method for manufacturing a device designed to enable a user to move an injured leg and foot resting in an extended position by looping the sole of the foot and lifting the foot so as to provide freedom of movement to the leg, comprising the following steps:

(a) providing a non-stretchable segment of tubing made of closed-cell polyethylene foam and having a hollow center, an inner surface and an outer surface, and having a curved middle section and two ends; said curved middle section being a substantially U-shaped foot portion, said two ends being two handle portions, and said non-stretchable segment of tubing being approximately five feet along and having an outside diameter of about 1.75 inches;

(b) providing a layer of non-slip material wrapped around said foot portion and said two handle portions; and (c) providing an inner core consisting of a segment of vinyl tubing inserted through the hollow center of said foam tubing and tied at each end of the foam tubing to prevent the inner core from sliding therethrough;

wherein the diameter of said vinyl tubing in only slightly smaller than the inside diameter of said foam tubing, so that the retention of the vinyl tubing within the foam tubing may be achieved simply by tying a knot at each end of the vinyl tubing; and wherein said layer of non-slip material wrapped around said foot portion and said two handle portions consists of non-slip rug cushioning material fastened to said segment of foam tubing by scoring said portions of the foam tubing to provide longitudinal slits between the inner and outer surfaces thereof; by extracting said vinyl tubing from inside the foam tubing through said slits; by enveloping each of said portions of the foam tubing with a band of said non-slip material having two loose ends and wrapping the loose ends thereof around the portion of vinyl tubing exposed through each slit; and finally by pushing the vinyl tubing with the loose ends of non-slip material wrapped around it back inside the foam tubing;

whereby said foot portion is used as a foot sling to hold and lift the foot of the user while clenching and pulling said two handle portions.

* * * * *

UNITED STATES PATENT AND TRADEMARK OFFICE

CERTIFICATE OF CORRECTION

PATENT NO. : 5,230,679
DATED : July 27, 1993
INVENTOR(S) : Alice V. Olsen

It is certified that error appears in the above-indentified patent and that said Letters Patent is hereby corrected as shown below:

Column 8, Claim 12, line 10, replace the word "along" with--long--.

Signed and Sealed this

First Day of February, 1994

Bruce Lehman

*Attest:*

BRUCE LEHMAN

*Attesting Officer*

*Commissioner of Patents and Trademarks*